US007156685B2

(12) United States Patent
Akutagawa

(10) Patent No.: US 7,156,685 B2
(45) Date of Patent: Jan. 2, 2007

(54) CONNECTOR

(75) Inventor: Syuhei Akutagawa, Tsu (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 10/567,910

(22) PCT Filed: Apr. 8, 2005

(86) PCT No.: PCT/JP2005/006907

§ 371 (c)(1),
(2), (4) Date: Feb. 10, 2006

(87) PCT Pub. No.: WO2005/099046

PCT Pub. Date: Oct. 20, 2005

(65) Prior Publication Data

US 2006/0270267 A1 Nov. 30, 2006

(30) Foreign Application Priority Data

Apr. 9, 2004 (JP) ..... 2004-115696

(51) Int. Cl.
*H01R 13/64* (2006.01)

(52) U.S. Cl. ..... 439/374; 439/607

(58) Field of Classification Search ..... 439/353–358, 439/607–610, 374–378
See application file for complete search history.

(56) References Cited

U.S. PATENT DOCUMENTS 4,653,837 A * 3/1987 Phillipson et al. ..... 439/607
6,821,158 B1 11/2004 Iida et al.

FOREIGN PATENT DOCUMENTS

| | | |
|---|---|---|
| JP | 2-119075 | 5/1990 |
| JP | 2000-215948 | 8/2000 |
| JP | 2001-223057 | 8/2001 |

OTHER PUBLICATIONS

English Language Abstract of JP 2001-223057.
English Language Abstract of JP 2000-215948.
English Language Abstract of JP 2-119075.

* cited by examiner

*Primary Examiner*—Khiem Nguyen
(74) *Attorney, Agent, or Firm*—Greenblum & Bernstein, P.L.C.

(57) ABSTRACT

In a connector comprised of a plug and a receptacle, displacement of the plug against the receptacle is lessened so that the plug is prevented to contact with a non corresponding post among the posts of the receptacle, and aligning portions of the plug and the receptacle are prevented from damage even when a force is applied obliquely when the plug is pulled out from the receptacle. For the purpose, guiding portions and guided portions are formed on members made of a metal such as shells for shielding electric noise among members constituting the plug and the receptacle. The guiding portions are a pair of grooved notches formed substantially parallel to an inserting/removing direction of the plug, and the guided portions are protrusions of substantially rectangular formed in the inserting/removing direction of the plug.

7 Claims, 6 Drawing Sheets

CONNECTOR

TECHNICAL FIELD

The present invention relates to a connector for electrically connecting electric apparatuses with each other.

BACKGROUND ART

As described in Japanese Laid-Open Patent Publication No. 2001-223057, for example, there has been conventionally provided a connector comprised of a plug and a receptacle attached to distinct electrical apparatuses, respectively, for electrically connecting the electric apparatus attached to the plug to the electric apparatus attached to the receptacle. When a plug is inserted into an insertion concave portion formed on the receptacle, contacts held on the plug come into contact with posts held on the receptacle, thereby electrically connecting the plug to the receptacle.

Generally, when the plug is connected to the receptacle, the contacts of the plug may not contact with the corresponding posts of the receptacle but possibly contact with posts which correspond to the other adjacent contacts due to displacement of the plug relative to the receptacle in the width direction. In order to prevent the displacement of the plug relative to the receptacle in the width direction, in conventional connectors, the size in the width direction of a connecting portion of the plug is, for example, set to be the substantially same as that of the insertion concave portion of the receptacle. Then, the plug is moved with respect to the receptacle while bringing a plug housing in contact with a connecting portion of a receptacle body, for example, to align the connecting portion of the plug to the insertion concave portion of the receptacle.

By the way, the plug housing and the receptacle body are formed of synthetic resin having relatively low mechanical strength. Thus, in pulling the plug out of the receptacle, when a force is applied to the plug obliquely against the longitudinal direction, an excessive force is given to the aligned portion of the plug relative to the receptacle, thereby causing possible damage of the pug housing and/or the receptacle body.

As shown in FIG. 6, for example, in pulling a plug 1 out of a receptacle 2, when a rightward force is applied to the rear end of the plug 1, the front end of the right wall of an inserting hole 34 of the plug 1 comes into contact with a connecting portion 62 of the receptacle 2 and at the same time, the front end of a receptacle shell 7 comes into contact with a connecting portion 33 of the plug 1. Thus, by leverage using the contact position between the front end of the receptacle shell 7 and the connecting portion 33 of the plug 1 as a fulcrum, a large force is applied to the front end of the right wall of the inserting hole 34 and the connecting portion 62. As a result, the right wall of the inserting hole 34 of the plug housing 3 and the connecting portion 62 of the receptacle body 6 may be damaged. When the portions for preventing displacement of the plug 1 are damaged like this, the displacement preventing effect cannot be obtained consequently, and thus, due to the displacement of the plug 1 relative to the receptacle 2 in the width direction, a contact 5*a* contacts with a post 8*b* adjacent to a post 8*a* to be properly contacted.

Thus, when the size of each component is set so that the connecting portion 33 of the plug 1 may not be in contact with the connecting portion 62 of the receptacle 2 and the receptacle shell 7 even if the plug 1 is skewed as shown in FIG. 6, the displacement of the plug 1 relative to the receptacle 2 cannot be prevented, and the contact 5*a* may come into contact with the post 8*b* other than the post corresponding to the contact 5*a*.

DISCLOSURE OF INVENTION

An object of the present invention is to provide a connector capable of preventing a plug from contacting with an improper post among posts of a receptacle by lessening displacement of the plug relative to the receptacle in width direction, and of preventing damage on aligning portions of the plug and the receptacle even when a force is applied thereto obliquely in pulling the plug out of the receptacle.

A connector in accordance with an aspect of the present invention comprises a plug having a plug housing that holds a plurality of contacts in parallel, and a receptacle that has an insertion concave portion into which the plug is inserted and holds a plurality of posts in the insertion concave portion parallel to a direction perpendicular to the plug inserting/removing direction, the contacts coming into contact with the posts to be electrically connected when the plug is inserted into the insertion concave portion.

A pair of guiding portions using outward faces arranged substantially parallel to the plug inserting/removing direction relative to the receptacle and in a direction of arrangement of the posts as guiding faces is provided on a member made of a metal of one of the plug and receptacle.

A pair of guided portions respectively coming into contact with the guiding faces of the pair of guiding portions is provided on a member made of a metal of the other of the plug and receptacle.

With such a configuration, alignment of the plug with respect to the receptacle in the direction of arrangement of the posts, that is, the width direction, by the pair of guiding portions and the pair of guided portions contacted thereto is performed. Thus, it is possible to prevent that each contact of the plug contacts with a post other than the corresponding post among the posts of the receptacle. Furthermore, since both of the guiding portions and the guided portions are formed on the members made of a metal of high mechanical strength, even when a force is applied to the plug obliquely in pulling the plug out of the receptacle, there is a very low possibility that the guiding portions and the guided portions will be damaged. Thus, even when the plug is inserted into or removed from the receptacle repeatedly, the aligning function of the plug relative to the receptacle is maintained. Still furthermore, since there is no need to use the members made of synthetic resin for the prevention of displacement of the plug as in conventional connectors, the synthetic resin members can be prevented from being damaged.

BRIEF DESCRIPTION OF DRAWINGS

FIG. 1A is a plan view, FIG. 1B is a right side view, FIG. 1C is a plan view showing a state where a cover is removed and FIG. 1D is a right side view showing the state where the cover is removed.

FIG. 2A is a plan view, FIG. 2B is a right side view, FIG. 2C is a sectional view taken along A—A in FIG. 2A

FIG. 3A is a plan view, FIG. 3B is a right side view and FIG. 3C is a sectional view taken along C—C in FIG. 3A.

FIG. 4A is a plan view, FIG. 4B is a front view, FIG. 4C is a right side view and FIG. 4D is a plan sectional view.

FIG. 5A shows a state where the plug and the housing are normally connected to each other and FIG. 5B shows a state where the plug is inserted obliquely against a normal inserting/removing direction of the plug.

BEST MODE FOR CARRYING OUT THE INVENTION

Hereinafter, a connector in accordance with an embodiment of the present invention will be described below with reference to figures. In this embodiment, in order to prevent displacement of a plug relative to a receptacle in width direction, a guiding portion and a guided portion are formed on a plug shell and a receptacle shell, respectively, which are formed of metal and have a relatively high mechanical strength.

First, a plug 1 will be described. FIGS. 1A to 1D show a configuration of the plug 1 of the connector in accordance with this embodiment. The plug 1 has a plug housing 3 made of a synthetic resin and a plug shell 4 made of a metal for shielding electromagnetic noise. FIGS. 2A to 2D show a configuration of the plug housing 3. FIGS. 3A and 3B show a configuration of the plug shell 4.

Figure 2A:
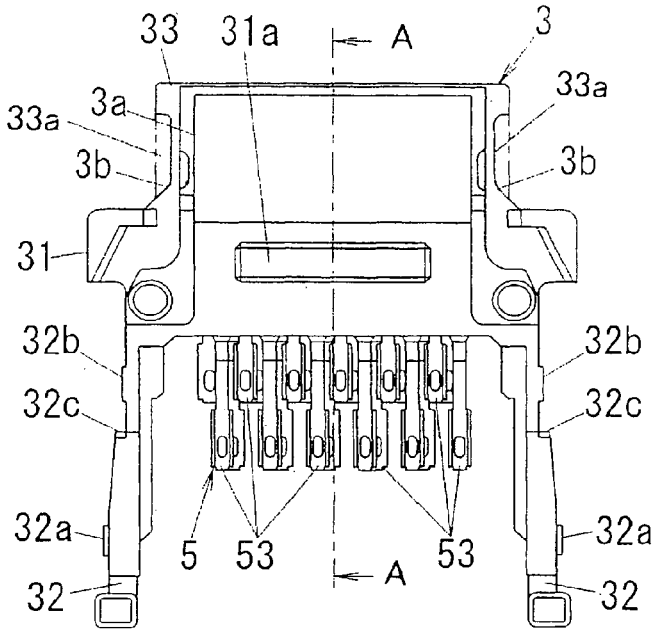
FIGS. 2A to 2C are views showing a plug housing in the above embodiment.
Figure 2B:
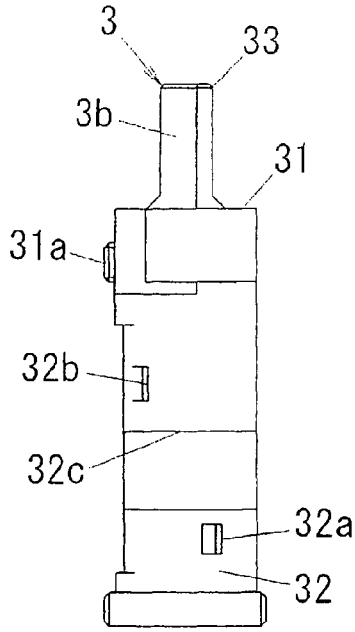
Figure 3A:
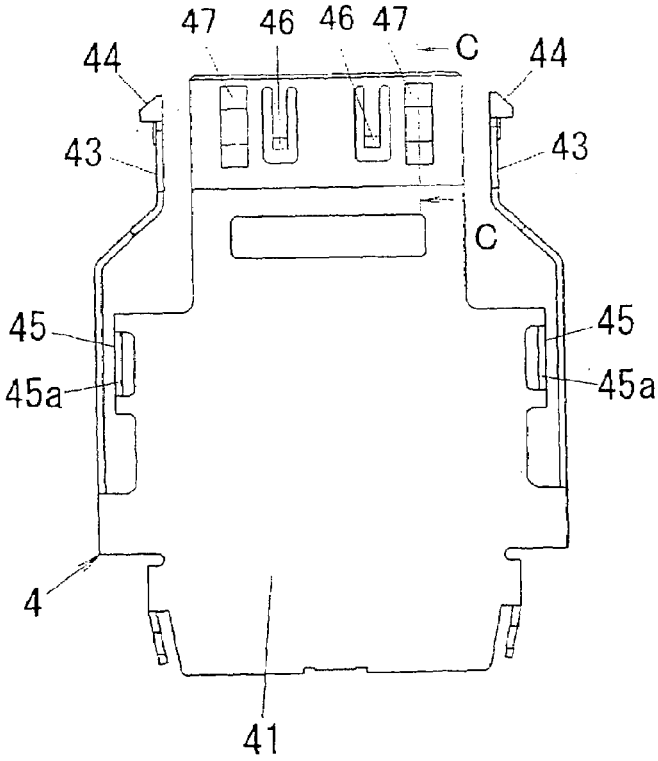
FIGS. 3A to 3C are views showing a plug shell in the above embodiment.
Figure 3B:
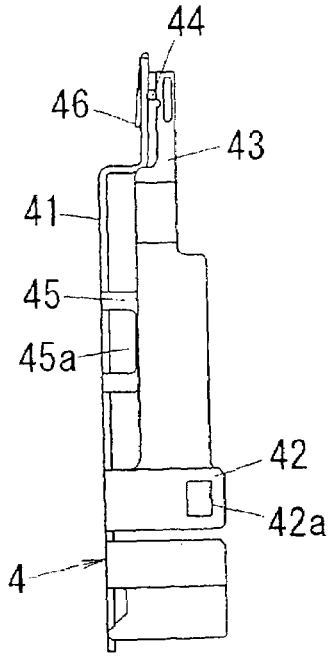
Figure 3C:
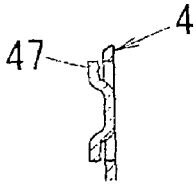

As shown in FIG. 2A, the plug housing 3 has a main body portion 31 that holds a plurality of contacts 5 arranged in the width direction, each of which is formed of a conductor such as a metal, and arm portions 32 formed so as to protrude rearwards from both ends of the main body portion 31 in the width direction. A connecting portion 33 inserted into an insertion concave portion 21 of a below-mentioned receptacle 2 is provided on a front end of the main body portion 31. As can be seen from FIGS. 2A and 2B, the connecting portion 33 is set to be smaller than the remaining portions of the main body portion 31 in the size in the width direction and in the height direction.

Figure 2D:
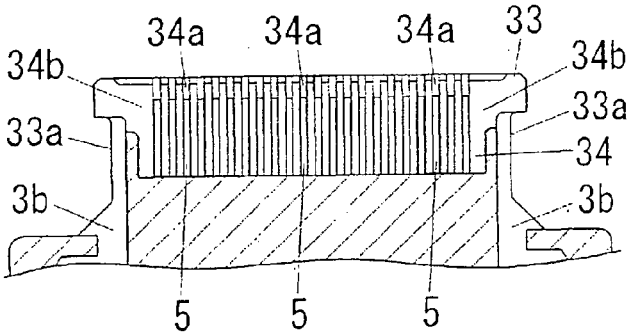
FIG. 2D is a sectional view taken along B—B in FIG. 2C.
Figure 2C:
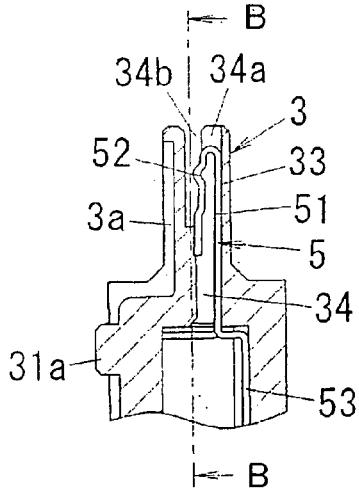

As shown in FIGS. 2C and 2D, an insertion hole 34 is formed so as to pass through the main body portion 31 in longitudinal direction., A plurality of holding grooves 34*a* opened backward and forward are provided on the bottom face of the insertion hole 34, and the contacts 5 each are held in the corresponding holding groove 34*a*.

As shown in FIG. 2C, each contact 5 is formed by bending an elongated band metal plate. The contacts 5 each have a holding portion 51 accommodated and held in the holding groove 34*a*, a contact portion 52 that is bent upwards from the front end of the holding portion 51 substantially in a U-letter shape, serves as a plate spring in top and bottom direction and contacts with a below-mentioned post 8 and a terminal portion 53 that is bent upwards or downwards from a rear end of the holding portion 51 and then extended rearwards. As shown in FIG. 2A, the adjacent contacts 5 are formed so that the terminal portions 53 are displaced from each other in the top and bottom direction and in the longitudinal direction.

As shown in FIGS. 3A and 3B, the plug shell 4 is formed, for example, by punching and bending a piece of metal plate. The plug shell 4 has a main body portion 41 disposed above the plug housing 3, protruding portions 42 formed to be bent downwards so as to hold the both arm portions 32 of the plug housing 3 therebetween from the left and right ends of the main body portion 41 and arm portions 43 that are extended forwards from the protruding portions 42 and serve as plate springs in the width direction. A front end of the main body portion 41 is bent downwards along the connecting portion 33 of the plug housing 3 so as to have a substantially L-letter shaped cross-section.

The vicinity of front ends of the arm portions 43 of the plug shell 4 each is bent so that a distance between them is smaller than that in root portions thereof. Furthermore, an engaging hook 44 which is bent to protrude outwards in the width direction is formed on an upper end in the vicinity of the front end of each of the arm portions. Still furthermore, an end face of the engaging hook 44 in the width direction is skewed so that protruded dimension becomes smaller toward the front.

As shown in FIG. 3A, engaging portions 45 which are bent downwards are formed at positions on both ends of the main body portion 41 and inner than the arm portions 43 in the width direction in front of the protruding portions 42 of the plug shell 4 and at positions. Furthermore, engaging holes 45*a* are formed so as to be adjacent to the inner side of the engaging portions 45 of the main body portion 41 in the width direction. Still furthermore, as shown in FIG. 3B, an engaging hole 42*a* is formed in the vicinity of a lower end of each protruding portion 42.

Furthermore, as shown in FIG. 3A, two slits of substantially U-letter shape and of forward-looking are formed at portions of the main body portion 41 of the plug shell 4 that is located above the connecting portion 33 of the plug housing 3, and earthing springs 46 are formed by bending the area surrounded by the slit upwards. The earthing springs 46 each protrudes above the top end of the connecting portion 33 of the plug housing 3 and has spring characteristic in the top and bottom direction. When the plug 1 is connected to the receptacle 2, the earthing springs 46 each comes into contact with the receptacle shell 7, so that both sides are electrically connected to each other. Thereby, the electric potential of the plug shell 4 can be made the same as that of the receptacle shell 7.

Guided protrusions 47 serving as a guided portion are respectively formed at outer sides of the earthing springs 46 of the main body portion 41 of the plug shell 4 in the width direction. The guided protrusions 47 each is a substantially rectangular protrusion in the longitudinal direction, which is formed by cutting and raising its front end and rear end in the longitudinal direction upwards. The guided protrusions 47 will be described in detail later.

A step portion 32*c* with its rear side protruding further than its front side is provided at an intermediate portion on an outer side face of each arm portion 32 of the plug housing 3 in the longitudinal direction. Furthermore, engaging protrusions 32*a* and 32*b* corresponding to the engaging holes 42*a* and 45*a* formed on the protruding portion 42 and the engaging portion 45 of the plug shell 4 are provided at the front side and the rear side of the step portion 32*c*, respectively. Then, by engaging the engaging protrusions 32*a* and 32*b* with the corresponding engaging holes 42*a* and 45*a*, the plug shell 4 is connected to the plug housing 3, as shown in FIG. 1C and FIG. 1D. Still furthermore, a connecting protrusion 31*a* of a substantially rectangular shape which is longer in the width direction is provided in a protruding condition on the top face of the main body portion 31 of the housing 3, and accordingly, a connecting hole 41*a* having substantially the same shape as the connecting protrusion 31*a* when viewed from above is formed on the main body portion 41 of the plug shell 4. When the plug shell 4 is connected to the plug housing 3, the plug shell 4 is positioned relative to the plug housing 3 by fitting the connecting protrusion 31*a* into the connecting hole 41*a*.

A concave portion 3*a* having substantially the same depth as a thickness of the plug shell 4 and substantially the same shape as a part of the main body portion 41 of the plug shell 4 is formed on the top face of the plug housing 3. Thus, in a state where the plug shell 4 is connected to the plug housing 3, the main body portion 41 of the plug shell 4 is accommodated in the concave portion 3*a* of the plug housing 3, thereby preventing from protruding upwards from the plug housing 3.

When viewed from above, storage grooves 3*b* opened in the longitudinal direction are provided adjoining to both ends of the concave portion 3*a* of the plug housing 3 in the width direction, and the vicinity of the front end of the arm portion 43 of the plug shell 4 is stored in the storage groove 3*b*. The front end of the storage groove 3*b* is also opened to the right and left sides of the connecting portion 33, and the engaging hooks 44 of the arm portions 43 of the plug shell 4 protrude outwards from the both sides of the connecting portion 33 in the width direction when viewed from above. The width dimension of the storage grooves 3*b* is set so that the arm portions 43 may bend until the whole of the engaging hooks 44 overlap the connecting portion 33 when viewed from above.

Figure 1A:
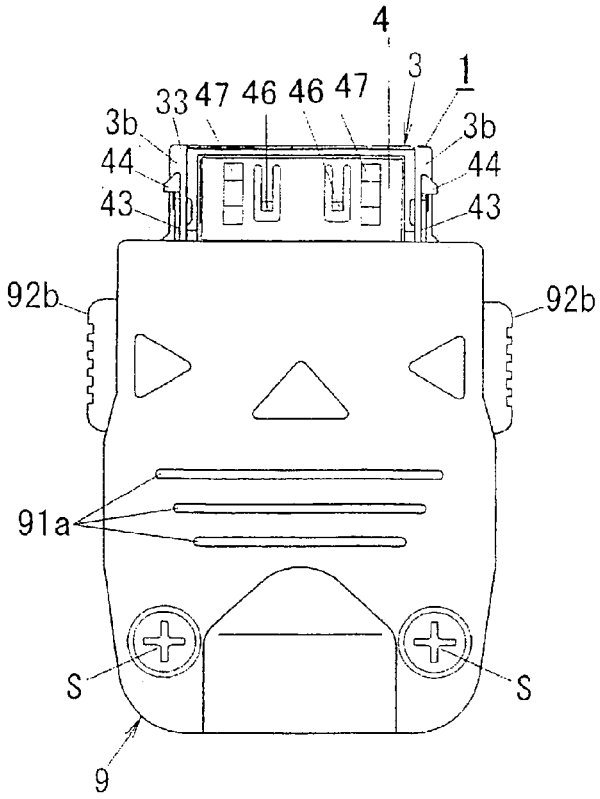
FIGS. 1A to 1D are views showing a plug of a connector in accordance with an embodiment of the present invention.
Figure 1B:
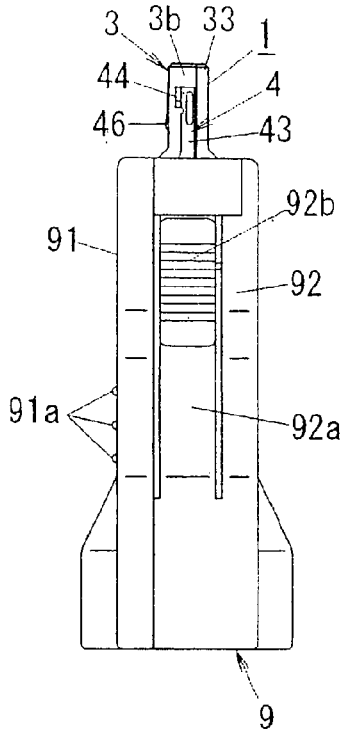
Figure 1C:
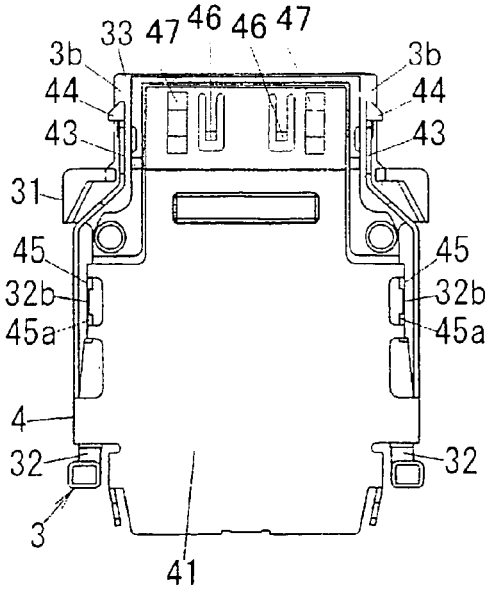
Figure 1D:
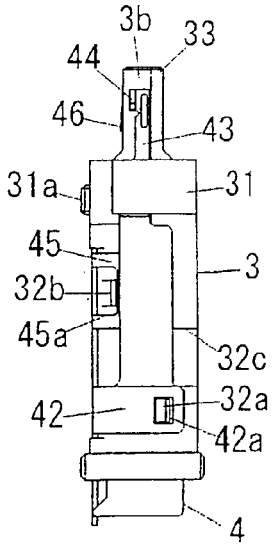

As shown in FIGS. 1A and 1B, the plug 1 has a cover 9 that covers the plug housing 3 and the plug shell 4 except for the portion inserted into an insertion concave portion 21 of the receptacle 2 described later. The cover 9 is formed of a synthetic resin, and comprised of a first cover body 91 that covers upper portions of the plug housing 3 and the plug shell 4 and a second cover body 92 that covers lower portions of the plug housing 3 and the plug shell 4. The first cover body 91 and the second cover body 92 are connected to each other by screws that pass through the first cover body 91 in the vertical direction and are screwed into the second cover body 92.

Spring portions 92*a* that is formed in the shape of a rectangle elongated in the longitudinal direction and can bend inwards in the width direction are provided on both side walls of the cover 9 in the width direction. Each of the spring portions 92*a* is connected to the other portion of the second cover body 92 only at its rear end. Furthermore, an operation protrusion 92*b* is formed in the vicinity of the front end of each spring portion 92*a* so as to protrude outwards in the width direction. In a state where the cover 9 is attached so as to cover the plug housing 3 and the plug shell 4, the spring portions 92*a* are provided at positions opposed to the arm portions 43 of the plug shell 4. When the operation protrusions 92*b* are pressed into the cover 9, the spring portions 92*a* are elastically deformed, thereby bending the arm portions 43 of the plug shell 4 inwards. Furthermore, three non-slip protrusions 91*a* horizontally-extended are arranged on the top face of the first cover body 91 in the longitudinal direction so that the hand may not slip when the plug 1 is inserted or removed into or from the receptacle by hand.

Figure 4A:
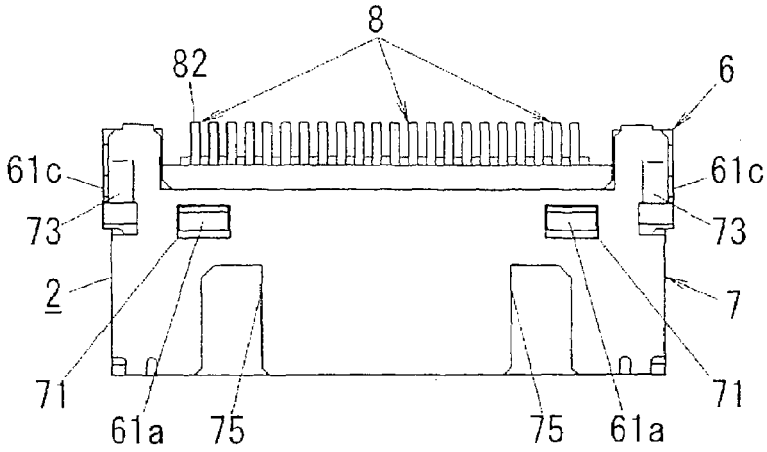
FIGS. 4A to 4D are views showing a receptacle of the connector in the above embodiment.
Figure 4B:
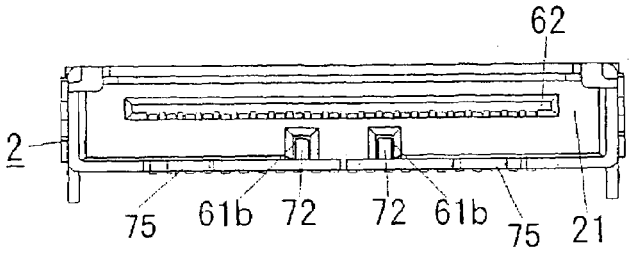

Subsequently, the receptacle 2 will be described. FIGS. 4A and 4B show a configuration of the receptacle 2. As shown in FIGS. 4A and 4B, the receptacle 2 comprises a receptacle body 6 formed of a synthetic resin, a plurality of posts 8 arranged and held on the receptacle body 6 in the width direction, a receptacle shell 7 formed of a metal plate in a shape of a substantially rectangular tube, and so on. The receptacle shell 7 is connected to the receptacle body 6 to form the insertion concave portion 21 into which the plug 1 is fitted, and has the function of shielding electromagnetic noise.

Figure 4C:
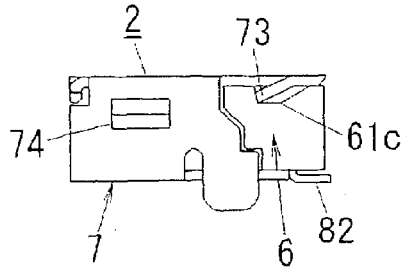
Figure 4D:
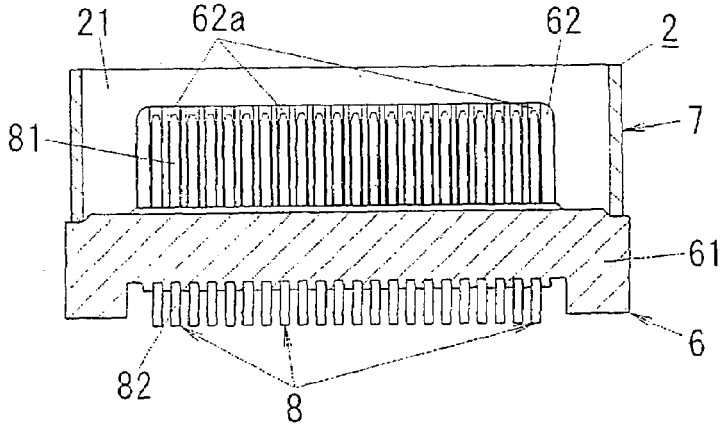

As shown in FIG. 4D, the receptacle body 6 comprises a main body portion 61 that is long in the width direction, and a connecting portion 62 that is provided so as to protrude rearwards from a rear face of the main body portion 61 and is inserted into the inserting holes 34 of the plug 1. The connecting portion 62 is formed in a shape of a flat plate having sizes in the width direction and in the height direction smaller than those of the main body portion 61. A plurality of storage grooves 62*a* that are extended in the longitudinal direction and opened at their rear ends are formed on the bottom face of the connecting portion 62, and a part of the post 8 is stored in each storage groove 62*a*.

The post 8 is formed by bending an elongated band metal plate. Each of the posts 8 has a contact portion 81 that is stored in the corresponding storage groove 62*a* of the receptacle body 6 and is in contact with the contact portion 52 of the contact 5, a holding portion (not shown) that is extended ahead of the contact portion 81 and held on the main body portion 61 of the receptacle body 6 and a terminal portion 82 that is extended ahead of the holding portion and installed on a printed wiring board (not shown) in an electrical apparatus, for example. As shown in FIG. 4C, the holding portion is bent so that the bottom face of the terminal portion 82 lies on substantially the same level as the bottom face of the receptacle shell 7 in the main body portion 61 of the receptacle body 6.

As shown in FIGS. 4B and 4D, the receptacle shell 7 is formed in a form of square tube by bending a metal plate so that both ends thereof are faced to each other in the middle of a bottom face of the receptacle body 6 in the width direction, the rear end thereof is opened and the front end thereof is closed by the receptacle body 6. As a result, the insertion concave portion 21 surrounded by the receptacle shell 7 is formed, and the connecting portion 62 is located on the bottom of the insertion concave portion 21.

As shown in FIG. 4A, connecting holes 71 are formed in the vicinities of both ends of the top face of the receptacle shell 7 in the width direction, respectively. Correspondingly, connecting protrusions 61*a* are formed in the vicinities of both ends of the top face of the main body portion 61 of the receptacle body 6 so as to protrude upwards. Furthermore, as shown in FIG. 4B, two connecting concave portions 61*b* arranged in the width direction are formed in the vicinity of the center of the bottom face of the main body portion 61 of the receptacle body 6 in the width direction. Correspondingly, connecting portions 72 are formed in the vicinity of the center of the bottom face of the receptacle shell 7 in the width direction by bending and raising a part of the metal plate. Still furthermore, as shown in FIGS. 4A and 4C, engaging concave portions 61*c* are formed at both ends of the top face of the main body portion 61 of the receptacle body 6 in the width direction, respectively. Correspondingly, connecting portions 73 are formed at both ends the top face of the receptacle shell 7 in the width direction by bending and raising a part of the metal plate. When the receptacle shell 7 is connected to the receptacle body 6, the connecting protrusions 61*a* of the receptacle body 6 each are fitted into the corresponding connecting holes 71 of the receptacle shell 7 and the connecting portions 72 and 73 of the receptacle shell 7 are each engaged with the corresponding connecting concave portions 61*b* and 61*c*. As a result, since the receptacle body 6 and the receptacle shell 7 are connected to each other in an integrated manner, and both elements cannot be easily separated from each other.

Furthermore, as shown in FIG. 4C, an engaging hole 74 is formed on each of both side walls of the receptacle shell 7 in the width direction. When the connecting portion 33 of the plug 1 is inserted into the insertion concave portion 21, the engaging hooks 44 of the arm portions 43 of the plug shell 4 come into contact with the right and left side walls of the receptacle shell 7, thereby bending the arm portions 44 and allowing the engaging hooks 44 to slide along inner faces of the both side walls of the receptacle shell 7. Then, the engaging hooks 44 are fitted into the engaging holes 74 and the arm portions 43 return to the original shape. As a result, the plug 1 is prevented from removing from the receptacle 2.

Furthermore, as shown in FIG. 4A, two guide notches 75 opened to their rear ends are arranged in the width direction at intermediate positions between both ends and the center on the top face of the receptacle shell 7. The guide notches 75 serve as the above-mentioned guiding portions. In the figure, the left side face of the right guide notch 75 and the right side face of the left guide notch 75 are parallel to the longitudinal direction, that is, the direction of inserting the plug 1 into the insertion concave portion 21.

When the connecting portion 33 of the plug 1 is inserted into the insertion concave portion 21 of the receptacle 2 configured as mentioned above, the connecting portion 62 of the receptacle body 6 is inserted into the inserting hole 34 of the plug housing 3, and the connecting portions 52 of the contacts 5 each contact with the connecting portion 81 of the corresponding post 8, individually. As a result, each contact 5 is electrically connected to the corresponding post 8.

To pull the plug 1 out of the receptacle 2, the operating protrusions 92*b* are pressed into the cover 9, thereby bending the arm portions 43 to release engagement of the engaging hooks 44 with the engaging holes 74. As shown in FIGS. 1A and 1B, a plurality of grooved non-slips extended are provided in the top and bottom direction on the outer face of each operating protrusion 92*b* in the width direction. Thus, in pulling the plug 1 out of the insertion concave portion 21 while pressing the operating protrusions 92*b*, the hand is hard to slip.

Subsequently, the guide notches 75 as guiding portions of the receptacle shell 7 and the guided protrusions 47 of the plug shell 4 for preventing displacement of the plug 1 relative to the receptacle 2 in the width direction in the characterizing part of this embodiment will be described in detail.

Figure 5A:
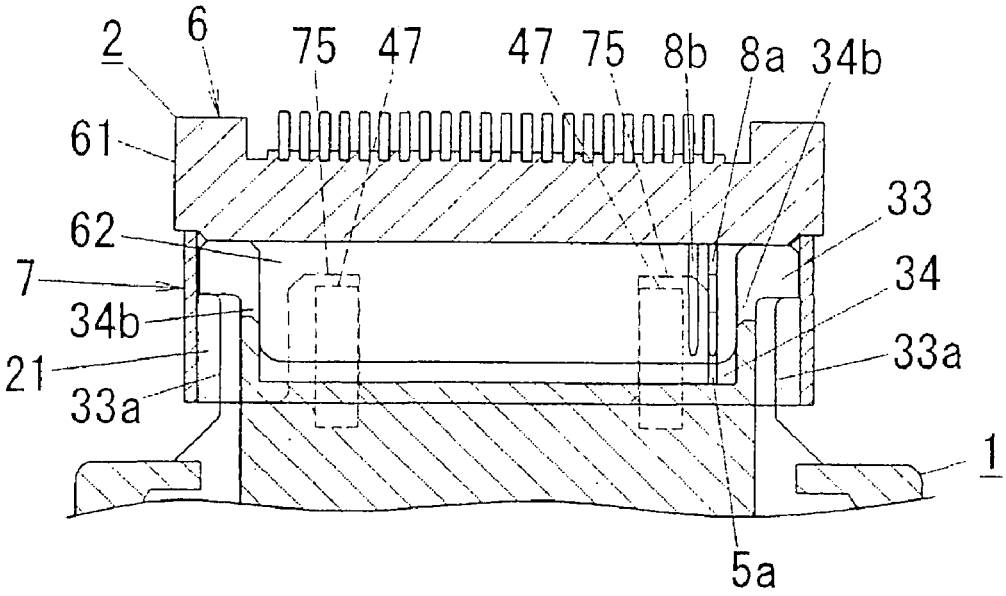
FIGS. 5A and 5B are views showing effect of the above embodiment.

A distance between the two guided protrusions 47 formed on the plug shell 4 is set to be slightly larger than a distance between the guide notches 75 formed on the receptacle shell 7. When the plug 1 is inserted into or removed from the insertion concave portion 21, as shown in FIG. 5A, the guided protrusion 47 at the right side in the figure comes into contact with the left end face of the guide notch 75 at the right side and the guided protrusion 47 at the left side comes into contact with the right end face of the guide notch 75 at the left side. Thus, the plug 1 is slidably guided with respect to the receptacle 2 in the longitudinal direction. In other words, the left end face of the guide notch 75 at the right side and the right end face of the guide notch 75 at the left side each serve as a guiding face. In a state where the connecting portion 33 of the plug 1 is completely inserted into the insertion concave portion 21, each contact 5 contacts with the corresponding post 8 and at the same time, each guided protrusion 47 comes into contact with the guiding face, so that the plug 1 is aligned with the receptacle 2 in the width direction.

With such configuration, in pulling the plug 1 out of the insertion concave portion 21 of the receptacle 2, even when a force is applied to the plug 1 obliquely, either of the guided protrusions 47 comes into contact with the guiding face of the corresponding guide notch 75, and thus, the plug 1 can hardly displace relative to the receptacle 2 in the width direction. Accordingly, it is prevented that each contact 5*a* in the insertion concave portion 21 of the receptacle 2 contacts with any post 8*b* other than the corresponding post 8*b*.

In this embodiment, since the guided protrusions 47 are formed by cutting and bending, the dimensional accuracy thereof is improved in comparison with the guided protrusions 47 formed by drawing. Furthermore, since a step between the guided portions 47 and the surrounding is sharply formed, contacting area between the guided protrusion 47 and the inner face of the guide notch 75 becomes larger, thereby stably preventing the displacement of the plug 1 relative to the receptacle 2 in the width direction.

By the way, since the peripheral portions of the guide notches 75 and the guided protrusions 47 are formed of metal, they are essentially hard to be damaged. However, depending on a magnitude of a force applied to the peripheral portions of the guide notches 75 and the guided protrusions 47, these portions may be damaged. Therefore, in this embodiment, in order to prevent the damage of the peripheral portions of the guided protrusions 47 and the guide notches 75, the width dimension of the guide notches 75 is set to be larger than that of the guided protrusions 47.

In making the width dimension of the guide notches 75 larger than that of the guided protrusions 47, as shown in FIG. 5A, a distance between the left end face of the guide notch 75 at the right side and the right end face of the guide notch 75 at the left side, which serve as guiding faces, is made substantially the same as but shorter by a predetermined tolerance than a distance between the left end face of the guided protrusion 47 at the right side and the right end face of the guided protrusion 47, and a distance between the right end face of the guide notch 75 at the right side and the left end face of the guide notch 75 at the left side is made much larger by a predetermined tolerance than a distance between the right end face of the guided protrusion 47 at the right side and the left end face of the guided protrusion 47 at the left side.

Figure 5B:
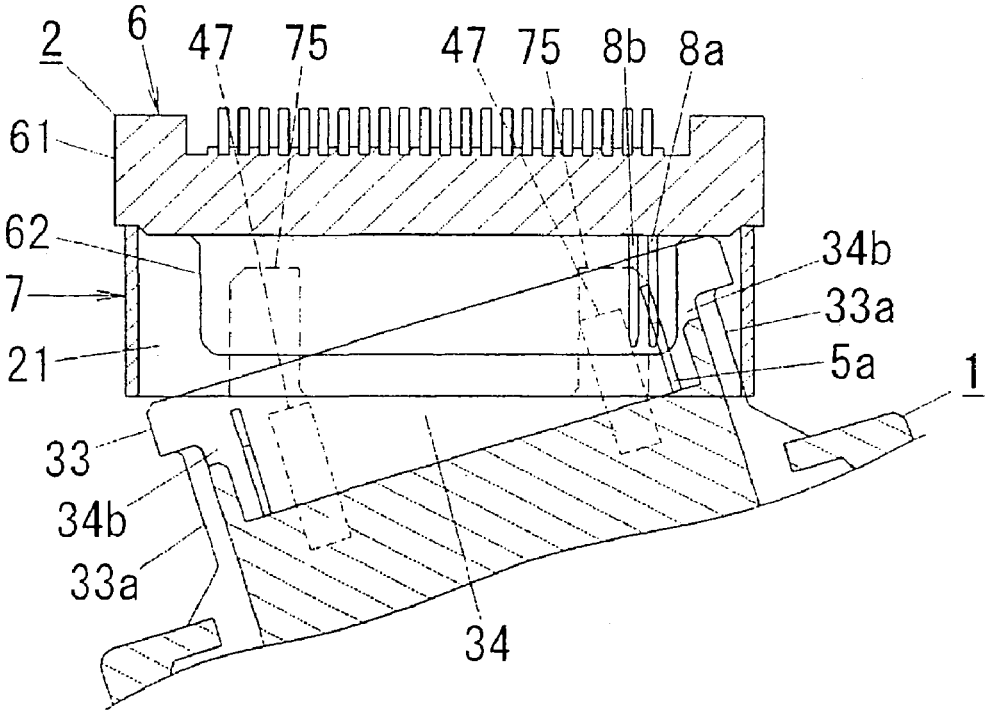
Figure 6:
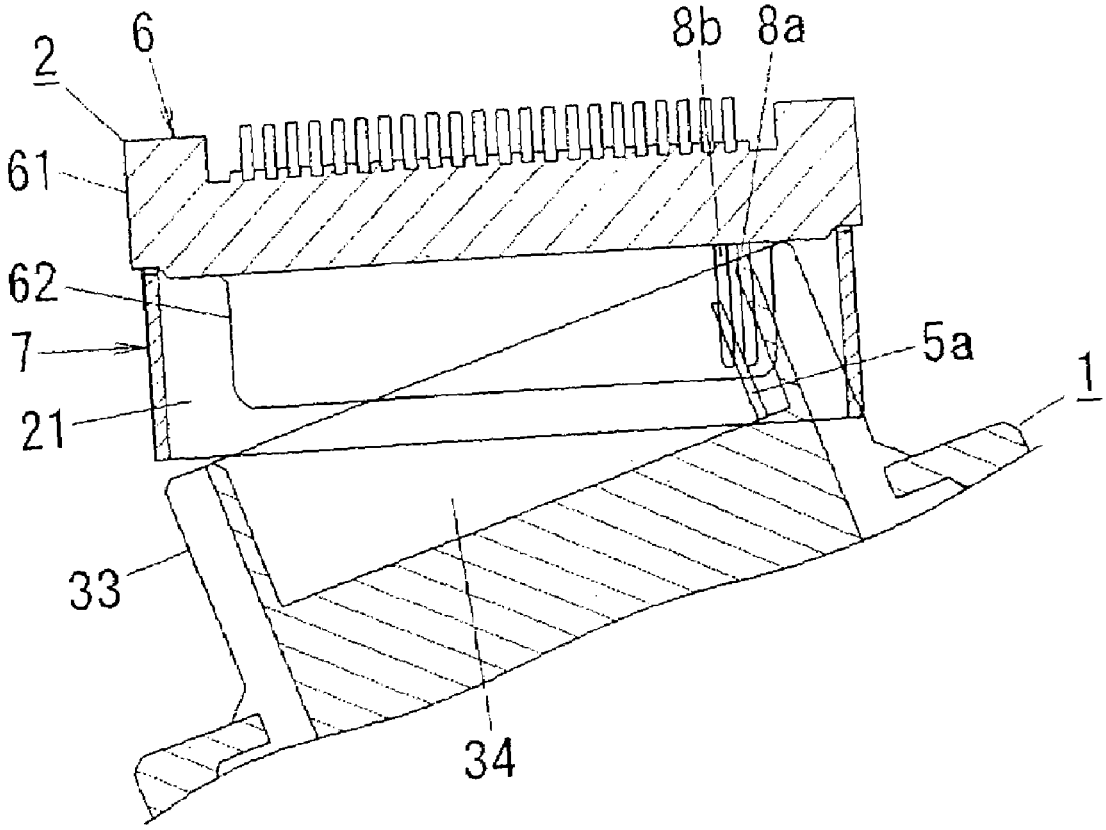
FIG. 6 is a view for describing problems of a conventional connector.

Thus, even when a force in the width direction is applied to the rear end of the plug 1 in pulling the plug 1 out of the insertion concave portion 21 of the receptacle 2, one of the guided protrusions 47 is removed from the guide notch 75 to skew the plug 1 and accordingly the other of the guided protrusions 47 can be turned in the guide notch 75, as shown in FIG. 5B. Thus, since no excessive force is applied to the guided protrusions 47, damage of the guided protrusions 47 can be prevented.

Furthermore, as shown in FIGS. 2A and 2C, a concave portion 33*a* for making the width dimension of the connecting portion 33 smaller and a notch 34*b* for opening both ends of the front end of the insertion hole 34 in the width direction are formed in the vicinity of each side of the connecting portion 33 of the plug housing 3 in the width direction. By forming the concave portions 33*a* on the both sides of the connecting portion 33 in this manner, interference of the both sides of the connecting portion 33 with the edges of the opening of the insertion concave portion 21 of the receptacle 2 can be lessened. Still furthermore, interference of the opening edge of the insertion hole 34 at the front side with the connecting portion 62 of the receptacle 2 can be also lessened. As a result, as shown in FIG. 5B, even when one of the guided protrusions 47 is removed from the guide notch 75 so that the plug 1 is skewed, the connecting portion 33 of the plug 1 comes into contact with the connecting portion 62 of the receptacle 2 or the receptacle shell 7, thereby preventing the portion made of a resin such as the connecting portion 33 of the plug housing 3 and the connecting portion 62 of the receptacle body 6 from being damaged.

In this embodiment, since the plug 1 is aligned by the guided protrusions 47 and the guide notches 75, it is no need to align the plug 1 by bringing the connecting portion 33 of the plug 1 into contact with the receptacle 2, and thereby, the above-mentioned concave portions 33*a* and the notches 34*b* can be provided.

Furthermore, the dimension of the concave portion 33*a* and the shape of the arm portions 43 may be set (not shown) so that the outer side faces of the arm portions 43 of the plug shell protrude to the left and right further than the inner faces of the concave portions 33*a* of the connecting portion 33 in a state where the engaging hooks 44 of the arm portions 43 of the plug shell 4 are engaged to the engaging holes 74 of the receptacle shell 7. In such a case, when the plug 1 is skewed as shown in FIG. 5B, the arm portions 43 of the plug shell 4 is pressed by the receptacle shell 7 entering into the concave portions 33*a* of the connecting portion 33, thereby the arm portions 43 is bent, and accordingly, engagement of the engaging hooks to the engaging holes 74 can be released. As a result, it is possible to easily detach the plug 1 from the receptacle 2 and also to prevent the deformation of the engaging hooks 44 and the arm portions 43, which is caused by pulling the plug 1 rearwards in a case where the engaging hooks 44 are engaged to the engaging holes 74.

In setting the depth dimension of the concave portions 33*a* of the connecting portion 33 of the plug housing 3, when the plug 1 is rotated counterclockwise relative to the receptacle 2 in the figure in a state where the front end of one of the guided protrusions 47 comes into contact with the guiding face of the guide notch 75 as shown in FIG. 5B, it is desirable that the inner face of the concave portion 33*a* comes into contact with the opening edge of the insertion concave portion 21 before the contact 5*a* contacts with the post 8*b* other than the corresponding post 8*b*. By setting the depth dimension of the concave portions 33*a*, the skew of the plug 1 relative to the receptacle 2 is limited into the skew extent by which the contact 5*a* may not contact with the post 8*b* other than the corresponding post 8*b*, and thereby, contact of each contact 5*a* with the non-corresponding post 8*b* can be prevented more stably.

By the way, in limiting the skew of the plug 1 relative to the receptacle 2 to the above-mentioned extent, it is also conceivable to utilize contact of a face opposite to the guiding face of the guide notch 75 with the guided protrusion 47 rather than to utilize contact of the connecting portion 33 of the plug housing 3 of the plug 1 with the opening edge of the insertion concave portion 21 of the receptacle 2. However, utilizing the contact of the connecting portion 33 of the plug 1 with the opening edge of the insertion concave portion 21 has an advantage of avoiding an excessive force applied to the guided protrusions 47 to prevent damage of the guided protrusions 47.

With the above-mentioned configuration of this embodiment, in the state where the plug 1 is connected to the receptacle 2, the displacement of the plug 1 can be prevented by bringing the guided protrusion 47 of the plug shell 4 into contact with the guiding face of the guide notch 75 of the receptacle shell 7, thereby preventing the contact 5*a* from contacting with the post 8*b* other than the corresponding post 8*b*. Furthermore, since it is unnecessary to prevent the displacement of the plug 1 by the connecting portion 33 of the resin plug housing 3 as in the conventional connectors, the connecting portion 33 can be provided with the concave portions 33*a* and the notches 34*a*, and thus, even when the plug 1 is pulled out obliquely, the plug housing 3 and the receptacle body 6 can be prevented from being damaged.

Still furthermore, since the plug shell 4 with the guided protrusions 47 and the receptacle shell 7 with the guide notches 75 each are formed of a metal having high mechanical strength, even when the force of pulling out the plug 1 obliquely is applied to these components, they are harder to be damaged as compared to the conventional connectors. This hardly impairs a function of preventing the displacement and can prevent the contact 5*a* from contacting with the post 8*b* other than the corresponding post 8*b*.

Still furthermore, since the guided protrusions 47 and the guide notches 75 are provided on the plug shell 4 and the receptacle shell 7 for shielding electromagnetic noise, respectively, the number of components is not increased as compared to the conventional connectors.

The present invention is not limited to the shape described in the description and shown in the figures of this embodiment, and it is only required that a pair of guiding portions, each of which has a face arranged in the direction substantially parallel to the direction of the plug inserting into or removing from the receptacle and in the direction of arrangement of the post (width direction) as a guiding face, are provided on one of the member made of a metal of the plug and the receptacle, and a pair of guided portions coming into contact with the guiding faces of the pair of guided portions, respectively, are provided on the other of the member made of a metal of the plug and the receptacle. In addition, the shapes of the guiding portions and the guided portions are not specifically limited.

In addition, it is preferred that the distance between the guiding faces of the pair of guiding portions is made substantially the same as the distance between the contact faces of the pair of guided portions but is shorter than the latter distance by a predetermined tolerance in the post arrangement direction.

Then, a pair of the guiding portions may be made as grooved notches formed substantially parallel to the inserting/removing direction of the plug and a pair of the guided portions may be made as substantially rectangular protrusions formed in the inserting/removing direction of the plug.

Furthermore, a pair of the guiding portions may use an inner face in the direction of arrangement of the posts among the faces of the grooved notches substantially parallel to the inserting/removing direction of the plug as a guiding face, and a pair of the guided portions may use an inner face in the direction of arrangement of the posts among the faces of the protrusions substantially rectangular shape substantially parallel to the inserting/removing direction of the plug as a guiding face.

Still furthermore, the distance between faces positioned outside in the direction of arrangement of the posts among faces of the grooved notches substantially parallel to the inserting/removing direction of the plug in a pair of the guiding portions may be made longer than the distance between faces positioned outside in the arrangement direction of the posts among the faces of the protrusions substantially rectangular shape substantially parallel to the inserting/removing direction of the plug by a predetermined tolerance or more.

This application is based on Japanese Patent Application No. 2004-115696 and the contents of which should be incorporated into the present invention by reference of the specification and figures of the above-mentioned patent application.

Although the present invention is fully described in the embodiment with reference to the appended figures, it is obvious for those skilled in the art to allow various changes and modifications. Therefore, it should be considered that such changes and modifications fall within the scope of the present invention without deviating from the scope of the invention.

The invention claimed is:

1. A connector comprised of a plug having a plug housing that holds a plurality of contacts in parallel, and a receptacle having an insertion concave portion into which the plug is inserted and holding a plurality of posts in the insertion concave portion parallel to a direction perpendicular to an inserting/removing direction of the plug, and the contacts coming into contact with the posts to be electrically connected when the plug is inserted into the insertion concave portion, characterized by that a pair of guiding portions, which uses faces arranged substantially parallel to the inserting/removing direction of the plug relative to the receptacle and arranged in a direction of arrangement of the posts as guiding faces, is provided on a member made of a metal of one of the plug and the receptacle, and a pair of guided portions, which comes into contact with the guiding faces of the pair of guiding portions, respectively, is provided on a member made of a metal of the other of the plug and the receptacle.

2. The connector in accordance with claim 1, characterized by that a distance between the guided faces of a pair of the guiding portions is substantially the same but smaller by a predetermined tolerance than a distance between contact faces of a pair of the guided portions in the direction of arrangement of the posts.

3. The connector in accordance with claim 2, characterized by that a pair of the guiding portions each is a grooved notch formed substantially parallel to the inserting/removing direction of the plug, and a pair of the guided portions each is a substantially rectangular protrusion formed in the inserting/removing direction of the plug.

4. The connector in accordance with claim 3, characterized by that a pair of the guiding portions each uses a face, which is positioned inside in the direction of arrangement of the posts among faces of the grooved notches substantially parallel to the inserting/removing direction of the plug, as a guiding face; and a pair of the guided portions each uses a face, which is positioned inside in the direction of arrangement of the posts among faces of the protrusions of substantially rectangular substantially parallel to the inserting/removing direction of the plug, as a guided face.

5. The connector in accordance with claim 4, characterized by that a distance between faces, which are positioned outside in the direction of the posts among the faces of the grooved notches serving as a pair of the guiding portion substantially parallel to the inserting/removing direction of the plug, is longer by the predetermined tolerance or more than a distance between faces, which are positioned outside in the direction of the posts among the faces of the protrusions of substantially rectangular serving as a pair of the guided portions substantially parallel to the inserting/removing direction of the plug.

6. The connector in accordance with claim 3, characterized by that the protrusions substantially rectangular serving as a pair of guided portions are formed by cutting and rising.

7. The connector in accordance with claim 1, characterized by that the members made of a metal of the plug and the receptacle each are a metal shell for shielding electromagnetic noise.

* * * * *